US008758660B2

(12) United States Patent
Kurian et al.

(10) Patent No.: US 8,758,660 B2
(45) Date of Patent: Jun. 24, 2014

(54) PROCESS OF MAKING HIGH CRIMP BICOMPONENT FIBERS

(75) Inventors: Joseph V. Kurian, Hockessin, DE (US); Gyorgyi Fenyvesi, Wilmington, DE (US); Hari Babu Sunkara, Hockessin, DE (US)

(73) Assignee: E I du Pont de Nemours and Company, Wilmington, DE (US)

( * ) Notice: Subject to any disclaimer, the term of this patent is extended or adjusted under 35 U.S.C. 154(b) by 1185 days.

(21) Appl. No.: 12/035,350

(22) Filed: Feb. 21, 2008

(65) Prior Publication Data

US 2008/0143009 A1 Jun. 19, 2008

Related U.S. Application Data

(62) Division of application No. 11/230,104, filed on Sep. 19, 2005, now Pat. No. 7,357,985.

(51) Int. Cl.

| | |
|---|---|
| ***D01D 5/08*** | (2006.01) |
| ***D01D 5/32*** | (2006.01) |
| ***D01F 8/14*** | (2006.01) |

(52) U.S. Cl.

USPC ..... 264/172.14; 264/172.17

(58) Field of Classification Search

USPC ..... 264/172.13, 172.14, 172.15, 172.17

See application file for complete search history.

(56) References Cited

U.S. PATENT DOCUMENTS

| | | | |
|---|---|---|---|
| 2,520,733 | A | 8/1950 | Morris at al. |
| 3,326,985 | A | 6/1967 | Mason |
| 3,454,460 | A | 7/1969 | Bosley |
| 3,671,379 | A | 6/1972 | Evans et al. |
| 5,015,789 | A | 5/1991 | Arntz et al. |
| 5,276,201 | A | 1/1994 | Haas et al. |
| 5,284,979 | A | 2/1994 | Haas et al. |
| 5,334,778 | A | 8/1994 | Haas et al. |
| 5,340,909 | A | 8/1994 | Doerr et al. |
| 5,364,984 | A | 11/1994 | Arntz et al. |
| 5,364,987 | A | 11/1994 | Haas et al. |
| 5,391,263 | A | 2/1995 | Hepner et al. |
| 5,434,239 | A | 7/1995 | Bhatia |
| 5,504,122 | A | 4/1996 | Michel et al. |
| 5,510,454 | A | 4/1996 | Stouffer et al. |
| 5,532,333 | A | 7/1996 | Stouffer et al. |
| 5,532,404 | A | 7/1996 | Gallagher |
| 5,540,868 | A | 7/1996 | Stouffer et al. |
| 5,633,018 | A | 5/1997 | Stouffer et al. |

(Continued)

FOREIGN PATENT DOCUMENTS

| | | | |
|---|---|---|---|
| JP | 11093022 | A | 4/1999 |
| JP | 1999189925 | A | 7/1999 |

(Continued)

OTHER PUBLICATIONS

International Search Report Dated Mar. 29, 2007, International Application No. PCT/US2006/036493, International Filing Date: Sep. 19, 2006.

*Primary Examiner* — Leo B Tentoni

(57) ABSTRACT

A bicomponent fiber wherein (a) the first component comprises from about 90 to 100 wt. % poly(trimethylene terephthalate) and (b) the second component is a polymer composition comprising (i) poly(trimethylene terephthalate) and (ii) polymer containing polyalkylene ether repeating units. Yarn, fiber, fabrics and carpets comprising the bicomponent fiber, as well as the process of making the bicomponent fiber, yarn, fabric, and carpet.

8 Claims, 3 Drawing Sheets

(56) References Cited

U.S. PATENT DOCUMENTS

| | | | | |
|---|---|---|---|---|
| 5,633,362 | A | 5/1997 | Nagarajan et al. | |
| 5,677,415 | A | 10/1997 | Bhatia | |
| 5,686,276 | A | 11/1997 | Laffend et al. | |
| 5,710,315 | A | 1/1998 | Gallagher | |
| 5,714,262 | A | 2/1998 | Stouffer et al. | |
| 5,730,913 | A | 3/1998 | Stouffer et al. | |
| 5,763,104 | A | 6/1998 | Stouffer et al. | |
| 5,774,074 | A | 6/1998 | Cooper et al. | |
| 5,786,443 | A | 7/1998 | Lowe | |
| 5,798,433 | A | 8/1998 | Schmidt et al. | |
| 5,811,496 | A | 9/1998 | Iwasyk et al. | |
| 5,821,092 | A | 10/1998 | Nagarajan et al. | |
| 5,830,982 | A | 11/1998 | Stouffer et al. | |
| 5,840,957 | A | 11/1998 | Kurian et al. | |
| 5,856,423 | A | 1/1999 | Bhatia | |
| 5,962,745 | A | 10/1999 | Brossmer et al. | |
| 5,990,265 | A | 11/1999 | Blanchard et al. | |
| 6,140,543 | A | 10/2000 | Brossmer et al. | |
| 6,153,679 | A | 11/2000 | Kawaji et al. | |
| 6,232,511 | B1 | 5/2001 | Haas et al. | |
| 6,235,948 | B1 | 5/2001 | Sunkara et al. | |
| 6,245,844 | B1 | 6/2001 | Kurian et al. | |
| 6,255,442 | B1 | 7/2001 | Kurian et al. | |
| 6,261,686 | B1 | 7/2001 | Schumann | |
| 6,277,289 | B1 | 8/2001 | Kurian et al. | |
| 6,281,325 | B1 | 8/2001 | Kurian et al. | |
| 6,284,930 | B1 | 9/2001 | Haas et al. | |
| 6,297,408 | B1 | 10/2001 | Haas et al. | |
| 6,312,805 | B1 | 11/2001 | Sun | |
| 6,316,586 | B1 | 11/2001 | Sunkara et al. | |
| 6,325,945 | B2 | 12/2001 | Kurian et al. | |
| 6,331,264 | B1 | 12/2001 | Kurian et al. | |
| 6,335,421 | B1 | 1/2002 | Kurian et al. | |
| 6,342,646 | B1 | 1/2002 | Haas et al. | |
| 6,350,895 | B1 | 2/2002 | Kurian | |
| 6,353,062 | B1 | 3/2002 | Giardino et al. | |
| 6,383,433 | B1 | 5/2002 | Schumann | |
| 6,437,193 | B1 | 8/2002 | Contractor et al. | |
| 6,538,076 | B2 | 3/2003 | Giardino et al. | |
| 6,555,220 | B1 | 4/2003 | Koyanagi et al. | |
| 6,562,457 | B1 | 5/2003 | Goldfinger et al. | |
| 6,576,340 | B1 | 6/2003 | Sun et al. | |
| 6,590,065 | B1 | 7/2003 | Goldfinger | |
| 6,599,625 | B2 | 7/2003 | Goldfinger et al. | |
| 6,608,168 | B1 | 8/2003 | Ng | |
| 6,635,347 | B1 * | 10/2003 | Yoshida | 428/395 |
| 6,641,916 | B1 | 11/2003 | Chang et al. | |
| 6,680,353 | B1 | 1/2004 | Kato et al. | |
| 6,692,687 | B2 | 2/2004 | Chang et al. | |
| 6,713,653 | B2 | 3/2004 | Higley | |
| 6,720,459 | B2 | 4/2004 | Sunkara et al. | |
| 6,723,799 | B2 | 4/2004 | Sun et al. | |
| 6,782,923 | B2 | 8/2004 | Covelli | |
| 6,787,630 | B1 | 9/2004 | Dominguez De Walter et al. | |
| 6,812,325 | B2 | 11/2004 | Higley | |
| 6,841,245 | B2 | 1/2005 | Chang et al. | |
| 6,858,702 | B2 | 2/2005 | Sun et al. | |
| 6,868,662 | B2 | 3/2005 | Rodgers | |
| 6,877,197 | B1 | 4/2005 | Van Trump et al. | |
| 6,905,765 | B2 | 6/2005 | Sunkara | |
| 6,921,803 | B2 | 7/2005 | Chang et al. | |
| 2002/0007043 | A1 | 1/2002 | Sunkara et al. | |
| 2002/0025433 | A1 | 2/2002 | Chang et al. | |
| 2003/0052436 | A1 * | 3/2003 | Koyanagi et al. | 264/178 R |
| 2004/0030095 | A1 | 2/2004 | Sunkara et al. | |
| 2004/0084796 | A1 | 5/2004 | Chang et al. | |
| 2004/0121151 | A1 | 6/2004 | Chang et al. | |
| 2004/0152925 | A1 | 8/2004 | Sunkara et al. | |
| 2004/0222544 | A1 | 11/2004 | Chang et al. | |
| 2004/0225107 | A1 | 11/2004 | Sunkara et al. | |
| 2004/0225161 | A1 | 11/2004 | Sunkara et al. | |
| 2004/0225162 | A1 | 11/2004 | Sunkara et al. | |
| 2004/0225163 | A1 | 11/2004 | Sunkara et al. | |
| 2004/0247868 | A1 | 12/2004 | Van Trump | |
| 2004/0260125 | A1 | 12/2004 | Seapan et al. | |
| 2005/0008855 | A1 | 1/2005 | Figuly et al. | |
| 2005/0020161 | A1 | 1/2005 | Dummer | |
| 2005/0020805 | A1 | 1/2005 | Sunkara et al. | |
| 2005/0039836 | A1 * | 2/2005 | Dugan et al. | 156/62.2 |
| 2005/0069997 | A1 | 3/2005 | Adkesson et al. | |
| 2005/0130545 | A1 | 6/2005 | Bansal et al. | |
| 2005/0272336 | A1 | 12/2005 | Chang et al. | |
| 2005/0282966 | A1 | 12/2005 | Sunkara et al. | |
| 2005/0283028 | A1 | 12/2005 | Sunkara et al. | |
| 2006/0009611 | A1 * | 1/2006 | Hayes | 528/272 |
| 2006/0041039 | A1 | 2/2006 | Fenyvesi et al. | |
| 2006/0084340 | A1 * | 4/2006 | Bond et al. | 442/340 |

FOREIGN PATENT DOCUMENTS

| | | | | |
|---|---|---|---|---|
| JP | 11222730 | A | | 8/1999 |
| JP | 2000 256919 | A | | 9/2000 |
| JP | 2000256918 | A | * | 9/2000 |
| JP | 2001123330 | A | | 5/2001 |
| JP | 2001123331 | A | * | 5/2001 |
| JP | 2002 056918 | A | | 2/2002 |
| WO | WO 03/040452 | A1 | | 5/2003 |
| WO | WO 2004/061169 | A1 | | 7/2004 |

* cited by examiner

PROCESS OF MAKING HIGH CRIMP BICOMPONENT FIBERS

PRIORITY

This application is a Divisional of U.S. patent application Ser. No. 11/230,104, filed Sep. 19, 2005 now U.S. Pat. No. 7,357,985, the disclosure of which is hereby incorporated herein by reference.

FIELD OF THE INVENTION

This invention relates to bicomponent fibers containing poly(trimethylene terephthalate) and processes for their manufacture.

BACKGROUND OF THE INVENTION

Poly(trimethylene terephthalate) (also referred to as "PTT") has received much attention as a polymer for use in textiles, flooring, packaging and other end uses. Textile and flooring fibers have excellent physical, chemical and dyeability properties.

It is well known that highly desirable crimp contraction properties, which lead to increased value in use for fibers, can be achieved by bicomponent fibers where the two components either have differing degrees of orientation, as indicated by differing intrinsic viscosities, or where the two components are different polymer species.

For example, U.S. Pat. No. 3,671,379 and U.S. Pat. No. 6,692,687 B2 disclose bicomponent polyester textile fibers wherein one of the components is poly(trimethylene terephthalate) and the other is poly(ethylene terephthalate).

US 2004-222544 A1 describes the preparation of bicomponent fibers where both components comprise poly(trimethylene terephthalate) with different physical properties. U.S. Pat. No. 6,641,916 B1 teaches the preparation of a side-by-side or eccentric sheath-core bicomponent fiber wherein each component comprises a different poly(trimethylene terephthalate) composition and wherein at least one of the compositions comprises styrene polymer dispersed throughout the poly(trimethylene terephthalate).

JP 11-189925 describes the manufacture of sheath-core fibers comprising poly(trimethylene terephthalate) as the sheath component and a polymer blend comprising 0.1 to 10 weight %, based on the total weight of the fiber, polystyrene-based polymer as the core component. According to this application, the core contains polystyrene and the sheath does not. Example 1 describes preparation of a fiber with a sheath of poly(trimethylene terephthalate) and a core of a blend of polystyrene and poly(trimethylene terephthalate), with a total of 4.5% of polystyrene by weight of the fiber.

JP 2000-256918 A discloses sheath-core or side-by-side bicomponent fibers wherein one side (A) comprises at least 85 mole percent poly(trimethylene terephthalate) and the other side comprises (B) at least 85 mole percent poly(trimethylene terephthalate) copolymerized with 0.05-0.20 mole percent of a trifunctional comonomer; or the other side comprises (C) at least 85 mole percent poly(trimethylene terephthalate) not copolymerized with a trifunctional comonomer wherein the inherent viscosity of (C) is 0.15 to 0.30 less than that of (A). It is disclosed that the bicomponent fibers obtained were pressure dyed at 130° C.

None of the aforementioned references discloses side-by-side or sheath-core bicomponent fibers where both components contain substantial amounts of the same poly(trimethylene terephthalate), nor do they disclose such poly (trimethylene terephthalate) containing bicomponent fibers that also contain a polyether based-component.

It is desired to prepare poly(trimethylene terephthalate) fibers with excellent crimp contraction, dyeability and softness. The invention described herein achieves these goals.

SUMMARY OF THE INVENTION

The invention is directed to a bicomponent fiber wherein (a) the first component comprises poly(trimethylene terephthalate) and (b) the second component is a polymer composition comprising (i) poly(trimethylene terephthalate) and (ii) polymer containing polyalkylene ether repeating units.

The first component preferably comprises from about 60 to 100 weight %, more preferably about 90 to 100 weight %, of the poly(trimethylene terephthalate), by weight of the polymer in the first component.

Preferably the weight ratio of the first component to the second component is at least about 30:70, more preferably at least about 40:60.

Preferably the weight ratio of the first component to the second component is up to about 70:30, more preferably up to about 60:40.

In one preferred embodiment, the bicomponent fiber is a side-by side bicomponent fiber.

In another preferred embodiment, the bicomponent fiber is a sheath-core bicomponent fiber.

In one preferred embodiment, the polymer containing polyalkylene ether repeating units is a poly(alkylene ether) glycol. Preferably the alkylene groups of the poly(alkylene ether) glycol contain from 2 to 10 carbon atoms. In one preferred embodiment, the poly(alkylene ether) glycol is poly (trimethylene ether) glycol. In another preferred embodiment, the poly(alkylene ether) glycol is poly(tetramethylene ether) glycol. In yet another preferred embodiment, the poly (alkylene ether) glycol is polyethylene glycol.

In another preferred embodiment, the polymers containing polyalkylene ether repeating units are copolymers made from poly(alkylene ether) glycol and at least one other polymer or monomer unit. Preferably the polymer containing polyalkylene ether repeating units is polyether ester copolymer. More preferably the polyether ester copolymer is a copolymer of (a) polyester selected from the group consisting of poly(ethylene terephthalate), poly(trimethylene terephthalate), poly(tetramethylene terephthalate), and copolymers and blends thereof; and (b) poly(alkylene ether) glycol selected from the group consisting of poly(trimethylene ether) glycol, poly (propylene ether) glycol, poly(tetramethylene ether) glycol, and copolymers and blends thereof. In one preferred embodiment, the polyether ester copolymer is a copolymer of poly (trimethylene terephthalate) and poly(trimethylene ether) glycol. In another preferred embodiment, the polyether ester copolymer is a copolymer of poly(tetramethylene terephthalate) and poly(trimethylene ether) glycol. In yet another preferred embodiment, the polyether ester copolymer is a copolymer of poly(tetramethylene terephthalate) and poly (tetramethylene ether) glycol.

In another preferred embodiment, the polymer containing polyalkylene ether repeating units is polytrimethylene ether ester amide.

Preferably the second component comprises from about 0.1 to about 30 wt. % of the polymer containing polyalkylene ether repeating units.

In a preferred embodiment, the second component contains from about 99.9 to about 70 wt. % poly(trimethylene terephthalate), by weight of the polymer used for the second component and about 0.1 to about 30 wt. % of the polymer containing polyalkylene ether repeating units, based on the weight of the polymer used for the second component. In a more preferred embodiment, (a) the first component comprises from about 95 to 100 wt. % poly(trimethylene terephthalate) and does not contain the polymer containing polyalkylene ether repeating units; and (b) the second component contains from about 99.5 to about 80 wt. % poly(trimethylene terephthalate), by weight of the polymer used for the second component and about 0.5 to about 20 wt. % of the polymer containing polyalkylene ether repeating units, based on the weight of the polymer used for the second component. In an even more preferred embodiment, (a) the first component comprises from about 98 to 100 wt. % poly(trimethylene terephthalate) and does not contain the polymer containing polyalkylene ether repeating units; and (b) the second component contains from about 97.5 to about 85 wt. % poly (trimethylene terephthalate), by weight of the polymer used for the second component and about 2.5 to about 15 wt. % of the polymer containing polyalkylene ether repeating units, based on the weight of the polymer used for the second component.

Preferably the bicomponent fibers have a crimp contraction from about 10% to about 90%. More preferably, the bicomponent fibers have a crimp contraction from about 55% to about 90%.

In one preferred embodiment, the poly(trimethylene terephthalate) used for the first component and the second component are the same.

The bicomponent fibers can be in the form of continuous filaments or staple fibers. Staple fibers can have a length of about 0.2 to 6 inches (about 0.5 to about 15 cm), more preferably about 0.5-about 3 inches (about 1.3-about 7.6 cm).

The invention is also directed to yarns and fabric comprising the bicomponent fiber. Preferred embodiments are woven fabrics, knitted fabrics and non-woven fabrics.

The invention is also directed to carpets made from the bicomponent fibers (e.g., filaments or staple fibers) of the invention.

The invention is further directed to a process for preparing a bicomponent fiber comprising: (a) providing as a first component comprising from about 90 to 100 wt. % poly(trimethylene terephthalate); (b) providing as a second component a polymer composition comprising (i) poly(trimethylene terephthalate) and (ii) polymer containing polyalkylene ether repeating units; and (c) spinning and processing the first component and the second component to form the bicomponent fiber.

Advantages of the bicomponent fibers and fabrics of this invention over other bicomponent fibers and fabrics include significantly better crimp properties, softer hand, higher dye-uptake, and the ability to dye under atmospheric pressure. Of particular note are the high crimp contraction values ranging from about 10% to about 85%.

DETAILED DESCRIPTION OF THE INVENTION

Figure 1:
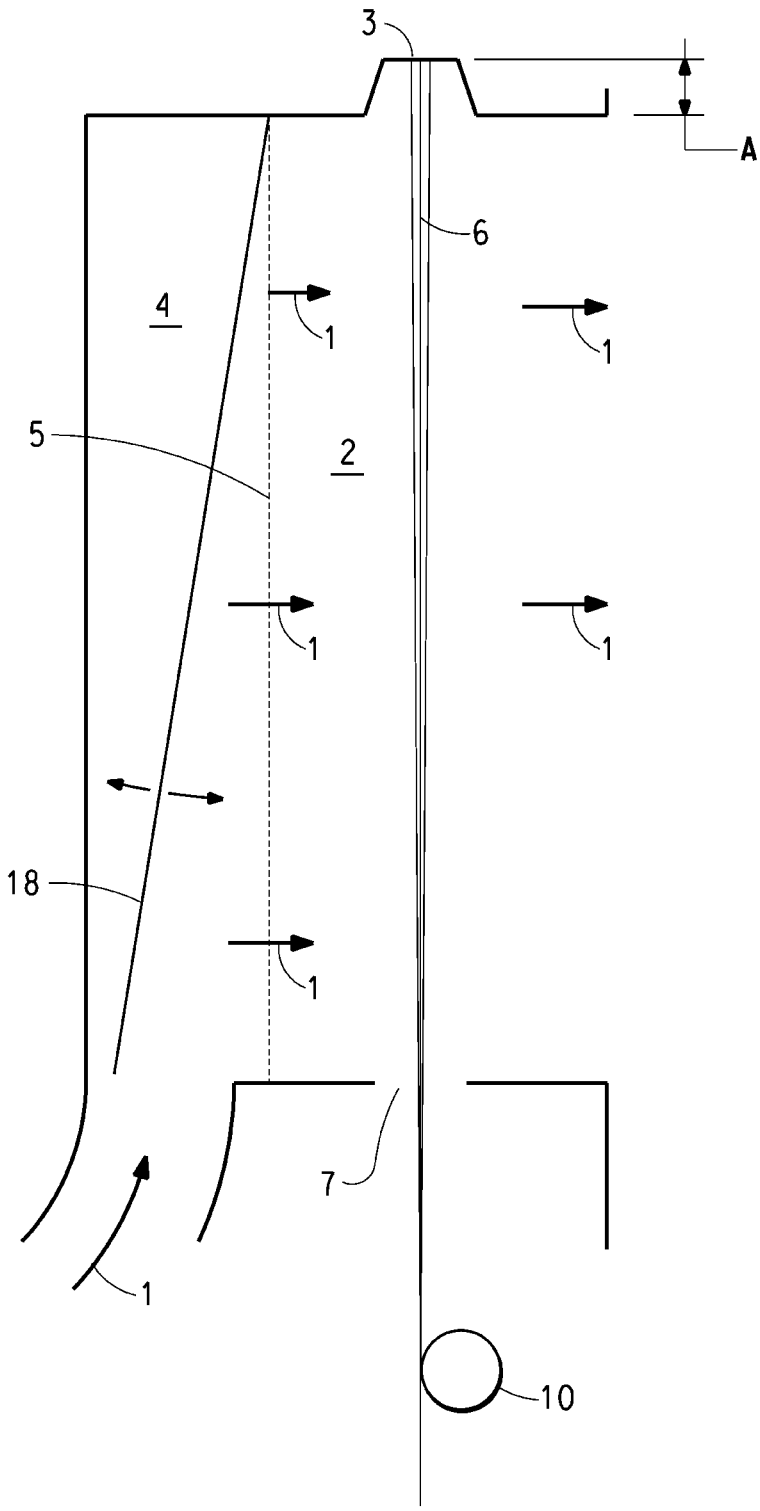
FIG. 1 is illustrates a cross-flow quench melt spinning apparatus useful in the process of the present invention.

All publications, patent applications, patents, and other references mentioned herein are incorporated by reference in their entirety. Unless otherwise defined, all technical and scientific terms used herein have the same meaning as commonly understood by one of ordinary skill in the art to which this invention belongs. In case of conflict, the present specification, including definitions, will control.

Except where expressly noted, trademarks are shown in upper case.

Although methods and materials similar or equivalent to those described herein can be used in the practice or testing of the present invention, suitable methods and materials are described herein.

Unless stated otherwise, all percentages, parts, ratios, etc., are by weight.

When an amount, concentration, or other value or parameter is given as either a range, preferred range or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Use of "a" or "an" are employed to describe elements and components of the invention. This is done merely for convenience and to give a general sense of the invention. This description should be read to include one or at least one and the singular also includes the plural unless it is obvious that it is meant otherwise.

The materials, methods, and examples herein are illustrative only and, except as specifically stated, are not intended to be limiting.

In describing and/or claiming this invention, the term "copolymer" is used to refer to polymers containing two or more monomers.

As used herein, "bicomponent fiber" means the art-recognized meaning of a fiber comprising a pair of polymer compositions intimately adhered to each other along the length of the fiber, so that the fiber cross-section is, for example, a side-by-side, sheath-core or other suitable cross-section from which useful crimp can be developed.

The first component of the bicomponent fiber of the invention comprises poly(trimethylene terephthalate) ("also referred to as PTT"). The PTT is preferably present in amount of from about 60 to 100 wt. %, by weight of the polymer in the first component. Preferably the first component comprise at least about 75 wt. %, more preferably at least about 85, even more preferably at least about 90 wt. %, more preferably at least about 95 wt. %, and most preferably at least about 98 wt. %, PTT, by weight of the polymer in the first component.

In the absence of an indication to the contrary, "poly(trimethylene terephthalate)" (PTT), in reference to the first or second component is meant to encompass homopolymers and copolymers containing at least 70 mole percent trimethylene terephthalate repeating units. The preferred poly(trimethylene terephthalate)s contain at least 85 mole percent, more preferably at least 90 mole percent, even more preferably at least 95 or at least 98 mole percent, and most preferably about 100 mole percent, trimethylene terephthalate repeating units.

Examples of copolymers include copolyesters made using 3 or more reactants, each having two ester forming groups. For example, a copoly(trimethylene terephthalate) can be used in which the comonomer used to make the copolyester is selected from the group consisting of linear, cyclic, and branched aliphatic dicarboxylic acids having 4-12 carbon atoms (for example butanedioic acid, pentanedioic acid, hexanedioic acid, dodecanedioic acid, and 1,4-cyclo-hexanedicarboxylic acid); aromatic dicarboxylic acids other than terephthalic acid and having 8-12 carbon atoms (for example isophthalic acid and 2,6-naphthalenedicarboxylic acid); linear, cyclic, and branched aliphatic diols having 2-8 carbon atoms (other than 1,3-propanediol, for example, ethanediol, 1,2-propanediol, 1,4-butanediol, 3-methyl-1,5-pentanediol, 2,2-dimethyl-1,3-propanediol, 2-methyl-1,3-propanediol, and 1,4-cyclohexanediol). The comonomer typically is present in the copolyester at a level in the range of about 0.5 to about 15 mole percent, and can be present in amounts up to 30 mole percent.

The PTT can be blended with up to about 40 weight % of other polymers, preferably polyester(s) and not the polymers containing polyalkylene ether repeating units (except in very minor amounts that would not significantly effect the performance of the fibers), by weight of the polymer in the first component. Preferably the first component comprise up to about 40 wt. %, more preferably up to about 25 wt. %, even more preferably up to about 15, even more preferably up to about 10 wt. %, more preferably up to about 5 wt. %, and most preferably up to about 2 wt. %, other polymer(s), by weight of the polymer in the first component. Examples are polyesters prepared from other diols, such as those described above.

The intrinsic viscosity of the poly(trimethylene terephthalate) used in the invention ranges from about 0.6 dl/g up to about 2.0 dl/g. Preferably the intrinsic viscosity is at least about 0.8 dl/g, more preferably at least about 0.9 dl/g, and even more preferably at least 0.95 dl/g. Preferably the intrinsic viscosity is about 1.5 dl/g or less, more preferably about 1.2 dl/g or less, even more preferably 1.1 dl/g or less, and most preferably 1.05 dl/g or less.

Poly(trimethylene terephthalate) and preferred manufacturing techniques for making poly(trimethylene terephthalate) are described in U.S. Pat. Nos. 5,015,789, 5,276,201, 5,284,979, 5,334,778, 5,364,984, 5,364,987, 5,391,263, 5,434,239, 5,510,454, 5,504,122, 5,532,333, 5,532,404, 5,540,868, 5,633,018, 5,633,362, 5,677,415, 5,686,276, 5,710,315, 5,714,262, 5,730,913, 5,763,104, 5,774,074, 5,786,443, 5,811,496, 5,821,092, 5,830,982, 5,840,957, 5,856,423, 5,962,745, 5,990,265, 6,232,511, 6,235,948, 6,245,844, 6,255,442, 6,277,289, 6,281,325, 6,297,408, 6,312,805, 6,325,945, 6,331,264, 6,335,421, 6,350,895, 6,353,062, 6,437,193, and 6,538,076, H. L. Traub, "Synthese und textilchemische Eigenschaften des Poly-Trimethylene-terephthalats", Dissertation Universitat Stuttgart (1994), S. Schauhoff, "New Developments in the Production of Poly (trimethylene terephthalate) (PTT)", Man-Made Fiber Year Book (September 1996), all of which are incorporated herein by reference. Poly(trimethylene terephthalate) useful as the polyester of this invention is commercially available from E. I. du Pont de Nemours and Company, Wilmington, Del., under the trademark SORONA®.

The second component is a polymer composition comprising (i) PTT and (ii) polymer containing polyalkylene ether repeating units. The composition is preferably provided in the form of a blend of the PTT and the polymer.

PTT is generally described with respect to the first component, and can contain the same other polymers, comonomers, etc., as described elsewhere herein.

The second component preferably contains from about 99.9 to about 70 wt. %, more preferably from about 99.5 to about 80 wt. %, and most preferably from about 97.5 to about 85 wt. % PTT, by weight of the polymer used for the second component.

The second component preferably contains from about 0.1 to about 30 wt. %, more preferably from about 0.5 to about 20 wt. %, and most preferably from about 2.5 to about 15 wt. % polymer containing polyalkylene ether repeating units.

While the second component of the bicomponent fiber of the invention is generally described with respect to the preferred embodiment containing PTT in a range of 99.9 to about 70 wt. %, it is noted the PTT can be blended with up to about 40 weight % percent of other polymers, preferably polyester(s), by weight of the polymer in the component. Examples are polyesters prepared from other diols, such as those described above. Thus, when such other polymers are present, the second component preferably contains from about 99.9 to about 70 wt. % polyester, more preferably from about 99.5 to about 80 wt. %, and most preferably from about 97.5 to about 85 wt. % polyester, by weight of the polymer in the second component. In this instance, the polyester portion of the second component preferably comprise up to about 40 wt. %, more preferably up to about 25 wt. %, more preferably up to about 15 wt. %, even more preferably up to about 10 wt. %, more preferably up to about 5 wt. %, and most preferably up to about 2 wt. %, of polyester(s) other than PTT.

The PTT used in the second component can have the same or different characteristics as the PTT used for the first component. Thus, the general description above concerning PTT applies to the PTT used in the second component. Preferably the same PTT is used in the first and second component (i.e., the PTT of the first component and the PTT of the second component have same chemical structure and physical properties). Indeed, it is a major advantage of the invention that a high crimp contraction bicomponent fiber can be prepared where both the first and second components contain substantial amounts of the same poly(trimethylene terephthalate), the second component differing from the first only by addition of a small quantity of polymer containing poly(alkylene ether) repeating units. Thus, this embodiment of the invention provides ease in storage and use of PTT for fiber manufacture by eliminating the need to store and use two types of PTT, or alter the properties of PTT for use in one of the components. (Similarly, if another polyester is present, that polyester is preferably used in equal amounts in both components.)

In one preferred embodiment of the invention, the polymer containing polyalkylene ether repeating units is a poly(alkylene ether) glycol.

The poly(alkylene ether glycol) preferably contains 2 to 10 carbon atom alkylene groups, more preferably from 2 to 5 carbon atom alkylene groups. They are preferably made by polycondensation of the corresponding alkylene diols, such as ethylene glycol, 1,3-propanediol, 1,2-propanediol, 1,4-butanediol, 3-methyl-1,5-pentanediol, 2,2-dimethyl-1,3-propanediol, 2-methyl-1,3-propanediol, and 1,4-cyclohexanediol. Preferred poly(alkylene ether glycol)s are poly (tetramethylene ether) glycol ("PO4G"), poly(trimethylene ether) glycol ("PO3G"), and polyethylene glycol ("PEG"), and blends and copolymers thereof, with PO3G and PO4G being most preferred.

Methods for preparation of PO3G and 1,3-propanediol for use in making PO3G are disclosed in U.S. Pat. Nos. 2,520,733; 3,326,985, 5,015,789, 5,276,201, 5,284,979, 5,334,778, 5,364,984, 5,364,987, 5,633,362, 5,686,276, 5,821,092, 5,962,745, 6,140,543, 6,232,511, 6,235,948, 6,277,289, 6,284,930, 6,297,408, 6,331,264 and 6,342,646, 6,720,459, US 2002-0007043 A1, US 2004-0152925 A1, US 2004-0225161 A1, US 2004-0225162 A1, US 2004-0225163 A1, US 2004-0225107 A1, US 2004-0260125 A1, and US 2005-0069997 A1, and in U.S. patent application Ser. No. 10/871,622, filed Jun. 18, 2004 Ser. No. 10/918,079, filed Aug. 12, 2004, Ser. No. 11/204,713, filed Aug. 18, 2005, and Ser. No. 11/204,731, filed Aug. 18, 2005, all of which are incorporated herein by reference.

PO3G's useful in practicing this invention can contain small amount of repeat units from aliphatic or aromatic diacid or diester, such as terephthalic acid or dimethyl terephthalate, preferably diacid, such as described in U.S. Pat. No. 6,608,168, which is incorporated herein by reference. They are prepared by polycondensation of 1,3-propanediol reactant and about 10 to about 0.1 mole percent of aliphatic or aromatic diacid or diester.

Poly(trimethylene-ethylene ether) glycol, such as described in US 2004-0030095 A1 (which is incorporated herein by reference) is an example of a suitable PO3G. Preferred poly(trimethylene-ethylene ether) glycols are prepared by acid catalyzed polycondensation of about 50 to about 99 mole % (preferably about 60 to about 98 mole % and more preferably about 70 to about 98 mole %) 1,3-propanediol and about 50 to about 1 mole % (preferably about 40 to about 2 mole % and more preferably about 30 to about 2 mole %) ethylene glycol.

The number average molecular weight of the poly(alkylene ether glycol) for use in the invention is preferably at least about 200, more preferably at least about 500, even more preferably at least about 1,000, and most preferably at least 1,500, and is preferably up to about 5,000, preferably up to about 3,500, even more preferably up to about 3,000, and most preferably up to about 2,500.

In another preferred embodiment of the invention, the polymer containing polyalkylene ether repeating units are copolymers made from poly(alkylene ether) glycol and at least one other polymer or monomer unit. These copolymers are preferably made from (A) at least one diol or poly(alkylene ether) glycol and (B) at least one other polymer or monomer unit. Preferred are polyether ester copolymer ("PEE"). Most preferred are copolymer(s) of (a) polyester selected from the group consisting of poly(ethylene terephthalate), poly(trimethylene terephthalate), poly(tetramethylene terephthalate), and copolymers and blends thereof; and (b) poly(alkylene ether) glycol (preferably containing $C_2$ to $C_{10}$ alkylene ether repeating units) selected from the group consisting of poly(trimethylene ether) glycol, poly(propylene ether) glycol, poly(tetramethylene ether) glycol, and copolymers and blends thereof. In preferred embodiments, (a) the PEE is a copolymer of poly(trimethylene terephthalate) and poly(trimethylene ether) glycol, such as described in U.S. Pat. No. 6,599,625 B1, U.S. Pat. No. 6,905,765 B1, and U.S. patent application Ser. No. 10/872,685, filed Jun. 21, 2004 (which are incorporated herein by reference), (b) the PEE is a copolymer of poly(tetramethylene terephthalate) and poly (trimethylene ether) glycol, such as described in U.S. Pat. No. 6,562,457 B1, U.S. Pat. No. 6,905,765 B1 and U.S. patent application Ser. No. 10/872,685, filed Jun. 21, 2004 (which are incorporated herein by reference), and (c) the PEE is a copolymer of poly(tetramethylene terephthalate) and poly (tetramethylene ether) glycol.

With particular reference to the PEE's prepared using poly (trimethylene ether) glycol, the PEE's preferably comprise about 90-about 60 weight % polyalkylene ether ester (as soft segment) and about 10-about 40 weight % polyester (as hard segment). The mole ratio of hard segment to soft segment is preferably at least about 2.0 and is preferably up to about 4.5. The PEE's preferably have an inherent viscosity of at least about 1.4 dl/g and preferably up to about 2.4 dl/g. The PEE's are preferably prepared by providing and reacting (a) poly (alkylene ether) glycol (e.g., poly(trimethylene ether) glycol or poly(tetramethylene ether) glycol), (b) 1,3-propanediol or 1,4-butanediol, and (c) dicarboxylic acid, ester, acid chloride or acid anhydride. The PEE's can also be prepared by reacting poly(alkylene ether) glycol (e.g., poly(trimethylene ether) glycol or poly(tetramethylene ether) glycol), and polyester (e.g., polytetramethylene ester or polytrimethylene ester (e.g., PTT)). Preferably, the dicarboxylic acid, ester, acid chloride or acid anhydride is an aromatic dicarboxylic acid or ester, more preferably selected from the group consisting of dimethyl terephthalate, bibenzoate, isophthalate, phthalate and naphthalate; terephthalic, bibenzoic, isophthalic, phthalic and naphthalic acid; and mixtures thereof. Most preferred are terephthalic acid and dimethyl terephthalate.

Other poly(alkylene ether) glycols, such as those useful as the polymer containing polyalkylene ether repeating units itself (e.g., from ethylene glycol, 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol, etc.) can be used to prepare suitable PEE's.

A wide range of molecular weights of the poly(alkylene ether) glycols (e.g., poly(trimethylene ether) glycol or poly (tetramethylene ether) glycol) can be used to make the PEE's. Preferably the poly(alkylene ether) glycol will have a minimum number average molecular weight ($M_n$) of at least about 200, preferably at least about 500, more preferably at least about 1,000, even more preferably at least about 1,500, and most preferably at least about 2,000. The maximum $M_n$ is preferably about 5,000, more preferably about 4,000, and most preferably about 3,500.

Figure 3:
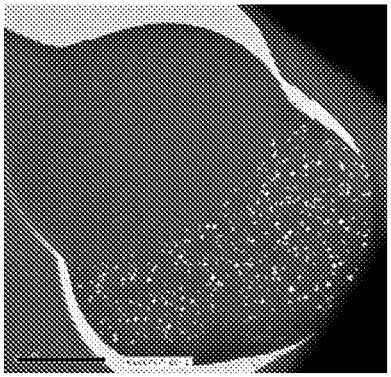
FIG. 3 is a Transmission Electron Microscopy photomicrograph (5K magnification) illustrating the cross-section of a bicomponent fiber of the invention having an "acorn" structure. The dispersed phase shown is the polymer containing polyalkylene ether repeating units.
Figure 4:
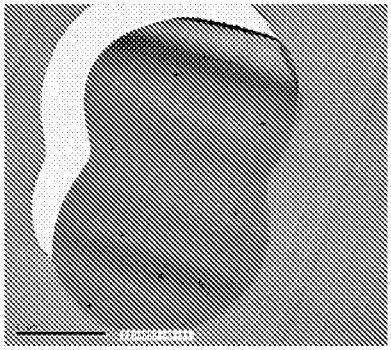
FIG. 4 is TEM photomicrograph TEM image (5K magnification) of a control bicomponent fiber having a symmetrical shape, where both components are poly(trimethylene terephthalate).

The soft segments in the second component can often be detected by electron microscopy. For example, FIG. 3 is a photomicrograph of a bicomponent fiber of the invention where the second component is a blend of poly(trimethylene terephthalate) and poly(tetramethylene ether) glycol. The white "balls" seen in the second component are the poly (tetramethylene ether) glycol. The diameter of the balls is approximately 100-200 nm. This second phase is absent in FIG. 4, which is an electron micrograph of a bicomponent fiber where both components are poly(trimethylene terephthalate). A few black "balls" are visible in FIGS. 3 and 4; these are titanium dioxide agglomerates.

The PEE's can comprise about 95 to about 5 weight % (preferably about 90 to about 50 weight %, and more preferably at least about 70 weight %) poly(alkylene ether) ester soft segment and about 5 to about 95 weight % (preferably about 10 to about 50 weight %, more preferably up to about 30 weight %) alkylene ester hard segment.

Another example of a polymer containing polyalkylene ether repeating units is a polytrimethylene ether ester amide, such as those described in U.S. Pat. No. 6,590,065 B1, which is incorporated herein by reference. The polyamide segment preferably has an average molar mass of at least about 300, more preferably at least about 400. Its average molar mass is preferably up to about 5,000, more preferably up to about 4,000 and most preferably up to about 3,000.

The polytrimethylene ether ester amide preferably comprises 1 up to an average of up to about 60 polyalkylene ether ester amide repeat units. Preferably it averages at least about 5, more preferably at least about 6, polyalkylene ether ester amide repeat units. Preferably it averages up to about 30, more preferably up to about 25, polyalkylene ether ester amide repeat units.

The polytrimethylene ether segment has an average molar mass of at least about 800, more preferably at least about 1,000 and more preferably at least about 1,500. Its average molar mass is preferably up to about 5,000, more preferably up to about 4,000 and most preferably up to about 3,500.

The polyether glycol used to form the soft segment is polytrimethylene ether glycol. At least 40 weight % of the polyalkylene ether repeat units are polytrimethylene ether repeat units. Preferably at least 50 weight %, more preferably at least about 75 weight %, and most preferably about 85 to 100 weight %, of the polyether glycol used to form the soft segment is polytrimethylene ether glycol.

The weight percent of polyamide segment, also sometimes referred to as hard segment, is preferably at least about 10% and most preferably at least about 15% and is preferably up to about 60%, more preferably up to about 40%, and most preferably up to about 30%. The weight percent of polytrimethylene ether segment, also sometimes referred to as soft segment, is preferably up to about 90%, more preferably up to about 85%, and is preferably at least about 40%, more preferably at least about 60% and most preferably at least about 70%.

The polymer containing polyalkylene ether repeating units can be a blend of the polymers described above, such as a blend of two or more poly(alkylene ether) glycols, PEE's and/or polytrimethylene ether ester amides.

The PTT of one or both components can be prepared with comonomers and additives, or blended. The comonomers or additives can be contained in one or both components. In other instances, the bicomponent fibers won't contain one or more of the comonomers or additives (or the one or more comonomers or additives will be present in such small quantities that it doesn't have a significant effect on the performance of the fibers). Some of the more important comonomers and additives used in PTT are discussed below, but this discussion is exemplary and should not be considered to be limiting.

The PTT of one or both components can contain about 0.01 to about 0.2 mole %, based on the total number of moles of 1,3-propanediol and diacid or ester (e.g., terephthalic acid or dimethyl terephthalate) used to form the PTT, of polyfunctional repeat units from polyfunctional reactant containing three or more carboxylic acid type groups or hydroxy groups, such as described in U.S. Provisional patent application Ser. No. 11/199,647, filed Aug. 9, 2005, which is incorporated herein by reference. The polyfunctional repeat units can be present in the same or different amounts, and may be the same or different, in each component. In another preferred embodiment, the bicomponent fibers don't contain PTT of this type (or it is present in such small quantities that it doesn't have a significant effect on the performance of the fibers).

Preferably, the polyfunctional reactant is selected from the group consisting of polycarboxylic acid having at least three carboxyl groups and polyols having at least three hydroxyl groups, or mixtures thereof. Preferably the polyfunctional reactant is polycarboxylic acid having 3 to 4 carboxyl groups, more preferably having 3 carboxyl groups. Preferably the polyfunctional reactant is polyol having 3-4 hydroxyl groups, more preferably having 3 hydroxyl groups. In one embodiment the polyfunctional reactant comprises polycarboxylic acid selected from the group consisting of trimesic acid, pyromellitic acid, pyromellitic dianhydride, benzophenone tetracarboxylic acid anhydride, trimellitic acid anhydride, benzenetetracarboxylic acid anhydride, hemimellitic acid, trimellitic acid, 1,1,2,2, ethanetetracarboxylic acid, 1,2,2-ethanetricarboxylic acid, 1,3,5-pentanetricarboxylic acid, 1,2,3,4-cyclopentanecarboxylic acid, and mixtures thereof. In another embodiment the polyfunctional reactant comprises polyol selected from the group consisting of glycerine, pentaerythritol, 2-(hydroxymethyl)-1,3-propanediol, trimethylolpropane, and mixtures thereof. Most preferably the polyfunctional reactant comprises trimesic acid.

Trifunctional comonomers, for example trimellitic acid, can also be incorporated for viscosity control.

The PTT can contain styrene polymer in one or both components. In a preferred embodiment, the styrene polymer is present in each of the components. In that embodiment, the styrene polymer in both components can be the same or different. Further, it can be used in the same or different amounts in each component. In a second preferred embodiment, the styrene polymer is in only one component.

Use of PTT containing styrene polymer in bicomponent fiber is described in US 2004-0084796 A1, which is incorporated herein by reference. One difference is that in this invention there is there is a preferred embodiment in which both components contain the same PTT. When use of the same PTT is preferred, use of the same styrene polymer in the same amounts in both components is preferred.

In an alternative embodiment, it is preferred to have different PTT's in the two components. For instance, while not necessary with this invention, use of PTT's having differing in intrinsic viscosity (IV) by about 0.03 to about 0.5 dl/g (preferably about 0.10 dl/g to about 0.3 dl/g) can enhance the crimp of a side-by-side bicomponent fiber. In one preferred embodiment the styrene polymer is in the component with the higher IV poly(trimethylene terephthalate). In a second preferred embodiment the styrene polymer is in the component with the lower IV poly(trimethylene terephthalate). In a third embodiment, the styrene polymer is in both components.

The styrene polymer is preferably present in a component in an amount of at least about 0.1%, more preferably at least about 0.5, and preferably up to about 10 weight %, more preferably up to about 5 weight %, and most preferably up to about 2 weight %, by weight of the polymers in the component.

By "styrene polymer" is meant polystyrene and its derivatives. Preferably the styrene polymer is selected from the group consisting of polystyrene, alkyl or aryl substituted polystyrenes and styrene multicomponent polymers. Here, "multicomponent" includes copolymers, terpolymers, tetrapolymers, etc., and blends.

More preferably the styrene polymer is selected from the group consisting of polystyrene, alkyl or aryl substituted polystyrenes prepared from □-methylstyrene, p-methoxystyrene, vinyltoluene, halostyrene and dihalostyrene (preferably chlorostyrene and dichlorostyrene), styrene-butadiene copolymers and blends, styrene-acrylonitrile copolymers and blends, styrene-acrylonitrile-butadiene terpolymers and blends, styrene-butadiene-styrene terpolymers and blends, styrene-isoprene copolymers, terpolymers and blends, and blends and mixtures thereof. Even more preferably, the styrene polymer is selected from the group consisting of polystyrene, methyl, ethyl, propyl, methoxy, ethoxy, propoxy and chloro-substituted polystyrene, or styrene-butadiene copolymer, and blends and mixtures thereof. Yet more preferably, the styrene polymer is selected from the group consisting of polystyrene, □-methyl-polystyrene, and styrene-butadiene copolymers and blends thereof. Most preferably, the styrene polymer is polystyrene.

The number average molecular weight of the styrene polymer is at least about 5,000, preferably at least 50,000, more preferably at least about 75,000, even more preferably at least about 100,000 and most preferably at least about 120,000. The number average molecular weight of the styrene polymer is preferably up to about 300,000, more preferably up to about 200,000 and most preferably up to about 150,000.

Useful polystyrenes can be isotactic, atactic, or syndiotactic, and with high molecular weight polystyrenes atactic is preferred. Styrene polymers useful in this invention are commercially available from many suppliers including Dow Chemical Co. (Midland, Mich.), BASF (Mount Olive, N.J.) and Sigma-Aldrich (Saint Louis, Mo.).

In another preferred embodiment, the bicomponent fibers don't contain styrene polymer (or styrene polymer is present in such small quantities that it doesn't have a significant effect on the performance of the fibers).

Some or all of the PTT in one or both components can be PTT comprising about 0.05 to about 5 mole % (preferably at least about 0.1 mole %, more preferably at least about 0.5 mole %, even more preferably at least about 1 mole %, preferably at least about 1.5 mole %, and preferably up to about 3 mole %, most preferably up to about 2.5 mole % most preferred is about 2 mole %) tetramethylene terephthalate repeat units, such as described with respect to PTT fibers in U.S. Pat. No. 6,921,803 B1, which is incorporated herein by reference. The tetramethylene terephthalate repeat units can be present in the same or different amounts, and may be the same or different, in each component. In another preferred embodiment, the bicomponent fibers don't contain PTT of this type (or it is present in such small quantities that it doesn't have a significant effect on the performance of the fibers).

In a preferred version of this embodiment, the poly(trimethylene terephthalate) composition comprises about 95 to about 99.95 mole % of the trimethylene terephthalate units and about 5 to about 0.05 mole % of the tetramethylene terephthalate repeat units. In another preferred embodiment, the poly(trimethylene terephthalate) composition can contain other polymer, copolymers, etc., as described in U.S. Pat. No. 6,921,803 B1. In such an embodiment, the PTT comprises about 70 to about 99.95 mole % of the PTT repeat units, about 5 to about 0.05 mole % of the tetramethylene terephthalate repeat units, and, optionally, up to 29.95 mole % of other polymeric units.

One or both components can contain about 0.05 to about 10 weight % ionomer, such as described with respect to use of ionomer in PTT fibers in US-2004-0121151-A1, which is incorporated herein by reference. The ionomer can be present in the same or different amounts, and may be the same or different, in each component. In another preferred embodiment, the bicomponent fibers don't contain ionomer (or ionomer is present in such small quantities that it doesn't have a significant effect on the performance of the fibers).

The PTT can include sulfonated dicarboxylic acid comonomer as described in U.S. Pat. No. 6,316,586 (which is incorporated herein by reference), such as 5-sodium-sulfoisophthalate comonomer, for example, at a level in the range of about 0.2 to 5 mole percent. Use of these comonomers improve cationic dyeability. The comonomer present in one or both of the components. When present in both components, the comonomer can be the same or different. Further, it can be used in the same or different amounts in each component. In another preferred embodiment, the bicomponent fibers don't contain this comonomer (or it is present in such small quantities that it doesn't have a significant effect on the performance of the fibers).

One or both components can comprise PTT comprising a polymeric additive for improved acid-dyeability such as described in U.S. Pat. No. 6,576,340 B1, U.S. Pat. No. 6,723,799 B1 and U.S. Pat. No. 6,713,653 B1, which are incorporated herein by reference. The additive can be present in the same or different amounts, and may be the same or different, in each component. In another preferred embodiment, the bicomponent fibers don't contain the additive (or it is present in such small quantities that it doesn't have a significant effect on the performance of the fibers). The PTT's of one embodiment comprise a secondary amine or secondary amine salt in an amount effective to promote acid-dyeability of the acid dyeable and acid dyed polyester compositions. Preferably, the secondary amine unit is present in the composition in an amount of at least about 0.5 mole percent, more preferably at least 1 mole percent. The secondary amine unit is present in the polymer composition in an amount preferably of about 15 mole percent or less, more preferably about 10 mole percent or less, and most preferably 5 mole percent or less, based on the weight of the composition. The acid-dyeable poly(trimethylene terephthalate) compositions of another embodiment comprise PTT and a polymeric additive based on a tertiary amine. The polymeric additive is preferably prepared from (i) triamine containing secondary amine or secondary amine salt unit(s) and (ii) one or more other monomer and/or polymer units. One preferred polymeric additive comprises polyamide selected from the group consisting of poly-imino-bisalkylene-terephthalamide, -isophthalamide and -1,6-naphthalamide, and salts thereof.

One or both components can comprise an antimicrobial additives, such as described in U.S. patent application Ser. No. 10/861,943, filed Jun. 4, 2004, which is incorporated herein by reference. Preferably, the antimicrobial additive is used in amount of about 0.1 to less than 2.0 mol %, based on the weight of the total polymer in the component, and preferably the antimicrobial additive is poly(6,6'-alkylimino-bishexamethylene adipamide), poly(6,6'-alkylimino-bistetramethylene adipamide), poly(N,N'-dialkylimino-tri(tetramethylene)) adipamide, or combinations thereof, wherein the alkyl group has 1 to about 4 carbon atoms. The additive can be present in the same or different amounts, and may be the same or different, in each component. In another preferred embodiment, the bicomponent fibers don't contain this additive (or it is present in such small quantities that it doesn't have a significant effect on the performance of the fibers).

One or both components can comprise cationically dyeable or dyed PTT such as those described in U.S. Pat. No. 6,312,805, which is incorporated herein by reference. The additive can be present in the same or different amounts, and may be the same or different, in each component. In another preferred embodiment, the bicomponent fibers don't contain the additive (or it is present in such small quantities that it doesn't have a significant effect on the performance of the fibers).

Other polymeric additives can be added to the PTT's of either component to improve strength, to facilitate post extrusion processing or provide other benefits. For example, hexamethylene diamine can be added in amounts of about 0.5 to about 5 mole percent to add strength and processability to the acid dyeable polyester compositions of the invention. Polyamides such as nylon 6 or nylon 6,6 can be added in amounts of about 0.5 to about 5 mole percent to add strength and processability to the acid-dyeable polyester compositions of the invention. A nucleating agent, preferably 0.005 to 2 weight % of a mono-sodium salt of a dicarboxylic acid selected from the group consisting of monosodium terephthalate, mono sodium naphthalene dicarboxylate and mono sodium isophthalate, as a nucleating agent, can be added as described in U.S. Pat. No. 6,245,844, which is incorporated herein by reference. These additives can be present in the same or different amounts, and may be the same or different, in each component. In another preferred embodiment, the bicomponent fibers don't contain one or all of these additives (or one or more of the additives is present in such small quantities that it doesn't have a significant effect on the performance of the fibers).

One or both components can contain fluorescent compound, such as described in U.S. patent application Ser. No. 10/961,724, filed Oct. 8, 2004, which is incorporated herein by reference. The fluorescent compound can be present in the same or different amounts, and may be the same or different, in each component. In another preferred embodiment, the bicomponent fibers don't contain fluorescent compound (or it is present in such small quantities that it doesn't have a significant effect on the performance of the fibers).

Each component can further comprise other additives, such as at least one additive selected from the group consisting of delusterants, heat stabilizers, viscosity boosters, optical brighteners, pigments, and antioxidants, including cobalt containing and phosphorus containing compounds known to be useful in PTT, hindered phenols, hindered amines, etc. These additives can be present in the same or different amounts, and may be the same or different, in each component. In another preferred embodiment, the bicomponent fibers don't contain one or all of these additives (or one or more of the additives is present in such small quantities that it doesn't have a significant effect on the performance of the fibers).

One preferred delusterant is $TiO_2$, which can be added to the PTT during manufacture or prior to fiber manufacture, and which is preferably used in amount of about 0.1 to about 0.5 weight %, by weight of the component. Preferably the $TiO_2$ is used in an amount of about 0.3 weight % in each component for dull fibers. Use of $TiO_2$ in PTT as a delusterant and for other purposes in making PTT is well known (See, e.g., U.S. Pat. Nos. 3,671,379, 5,798,433, 5,340,909, 6,153,679, 6,680,353, and 6,787,630, which are incorporated herein by reference.

The process for preparing the side-by side or sheath-core bicomponent fiber of the invention comprises: (a) providing a first component comprising from about 90 to 100 wt. % poly(trimethylene terephthalate) and a second component that is a composition comprising poly(trimethylene terephthalate) and polyalkylene ether repeating units; and (b) spinning the components to form bicomponent fibers.

The PTT can be provided by any known technique, including physical blends and melt blends. Preferably the polymers utilized in preparing the second component are melt blended and compounded. More specifically they are mixed and heated at a temperature sufficient to form a blend, and upon cooling, the blend is formed into a shaped article, such as pellets. The ingredients can be formed into a blended composition in many different ways. For instance, they can be (a) heated and mixed simultaneously, (b) pre-mixed in a separate apparatus before heating, or (c) heated and then mixed, for example by transfer line injection. The mixing, heating and forming can be carried out by conventional equipment designed for that purpose such as extruders, Banbury mixers or the like. The temperature should be above the melting points of each component but below the lowest decomposition temperature, and accordingly must be adjusted for any particular composition of PTT and polymer containing polyalkylene ether repeating units (e.g., PEE, and poly(alkylene ether glycol)). The temperature is typically in the range of about 200° C. to about 270° C., most preferably at least about 250° C. and preferably up to about 280° C., depending on the particular polymers utilized.

The two polymer compositions are melt-spun from a spinneret to form a bicomponent fiber. Processes and equipment generally applicable to spinning this class of bicomponent fibers can be used. Typical spinning processes and spinneret design are disclosed in U.S. Pat. No. 6,641,916 B1, US 2002/0025433A1 and US 2004-02225444 A1, all of which are incorporated herein by reference.

FIG. 1. illustrates a crossflow melt-spinning apparatus which is useful in the process of the invention. Quench gas 1 enters zone 2 below spinneret face 3 plenum 4, past hinged baffle 18 and through screens 5, resulting in a substantially laminar gas flow across still-molten fibers 6 which have just been spun from capillaries (not shown) in the spinneret. Baffle 18 is hinged at the top, and its position can be adjusted to change the flow of quench gas across zone 2. Spinneret face 3 is recessed above the top of zone 2 by distance A, so that the quench gas does not contact the just-spun fibers until after a delay during which the fibers may be heated by the sides of the recess. Alternatively, if the spinneret face is not recessed, an unheated quench delay space can be created by positioning a short cylinder (not shown) immediately below and coaxial with the spinneret face. The quench gas, which can be heated if desired, continues on past the fibers and into the space surrounding by the moving fibers which leave zone 2 through fiber exit 7. Finish can be applied to the now-solid fibers by optional finish roll 10, and the fibers can then be passed to the rolls illustrated in FIG. 2.

Figure 2:
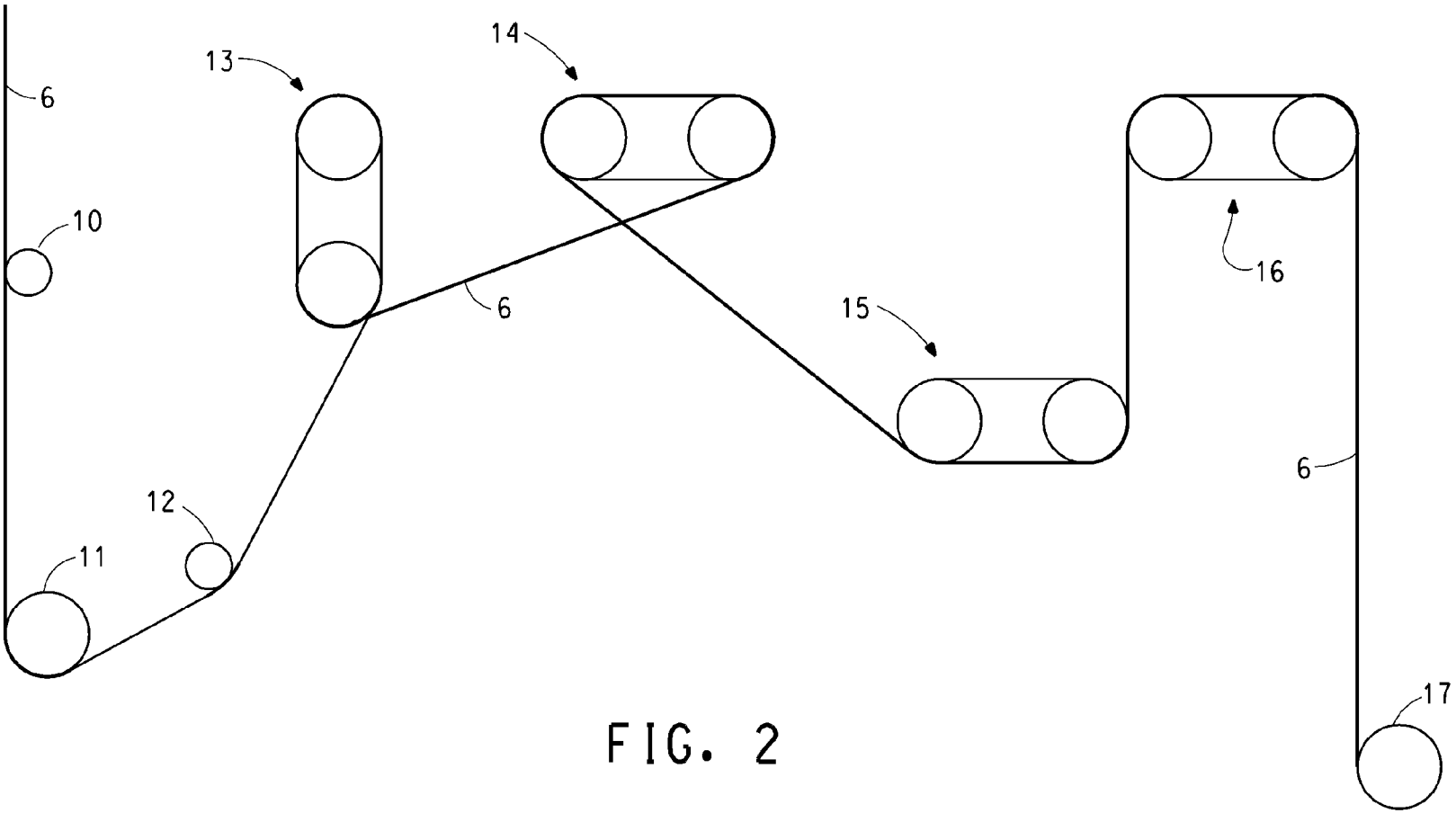
FIG. 2 illustrates an example of a roll arrangement that can be used in the process of the present invention.

In FIG. 2, fiber 6, which has just been spun for example from the apparatus shown in FIG. 1, can be passed by (optional) finish roll 10, around driven roll 11, around idler roll 12, and then around heated feed rolls 13. The temperature of the heated feed rolls can be in the range of about 50° C. to about 80° C. The fiber can then be drawn by heated draw rolls 14. The temperature of draw rolls 14 can be in the range of about 50° C. to 170° C., preferably about 80° C. to 120° C. The draw ratio (the ratio of wind-up speed to withdrawal or feed roll speed) is in the range of about 1.4 to about 4.5, preferably about 2.5 to 4.0. No significant tension (beyond that necessary to keep the fiber on the rolls) needs to be applied between the pair of rolls 13 or between the pair of rolls 14.

After being drawn by rolls 14, the fiber can be heat-treated by rolls 15, passed around optional unheated rolls 16 (which adjust the yarn tension for satisfactory winding), and then to windup 17. Heat treating can also be carried out with one or more other heated rolls, steam jets or a heating chamber such as a "hot chest". The heat-treatment can be carried out at substantially constant length, for example, by rolls 15 in FIG. 2, which heat the fiber to a temperature in the range of about 110° C. to about 180° C., preferably about 120° C. to about 170° C. The duration of the heat-treatment is dependent on yarn denier; what is important is the fiber can reach substantially the same temperature as that of the rolls. If the heat-treating temperature is too low, crimp can be reduced under tension at elevated temperatures, and shrinkage can be increased. If the heat-treatment temperature is too high, operability of the process becomes difficult because of frequent fiber breaks. It is preferred that the speeds of the heat-treating rolls and draw rolls be substantially equal in order to keep fiber tension substantially constant at this point in the process and thereby avoid loss of fiber crimp.

Alternatively, the feed rolls can be unheated, and drawing can be accomplished by a draw-jet and heated draw rolls which also heat-treat the fiber. An interlace jet optionally can be positioned between the draw/heat-treat rolls and windup.

Finally, the fiber is wound up. A typical wind up speed in the manufacture of the products of the present invention is 2,500 meters per minute (mpm).

Other steps conventionally used in bicomponent fiber spinning can also be incorporated into the process for preparing the fibers of the invention, e.g. application of spin finishes and cutting the fibers into staple fibers.

In one preferred embodiment, the bicomponent fibers are side-by-side bicomponent fibers. In another preferred embodiment, the bicomponent fibers are sheath-core bicomponent fibers. By reference to side-by-side and sheath-core fibers, it is intended to include bicomponent fibers that are described in the art as being either concentric or eccentric sheath-core bicomponent fibers, as well as other bicomponent fibers having the general definition of bicomponent fibers given above. They can be round, substantially round, oval, scalloped oval, octalobal, delta, sunburst (also known as sol), trilobal, tetra-channel (also known as quatra-channel), scalloped ribbon, ribbon, acorn, snowman, starburst, etc. They can be solid, hollow or multi-hollow. They can have many other shapes, and can have many different features, as is well known in the art.

For instance, side-by-side fibers made by the process of the invention can have a "snowman" ("A"), oval ("B"), or substantially round ("C1", "C2") cross-sectional shape as illustrated in U.S. Pat. No. 6,641,916, which is incorporated herein by reference. Other shapes can also be prepared. For example FIG. 3 illustrates an "acorn" shape, and FIG. 4 a "symmetrical" shape. The sheath-core fibers preferably have an oval or substantially round cross-sectional shape. By "substantially round" it is meant that the ratio of the lengths of two axes crossing each other at 90° in the center of the fiber cross-section is no greater than about 1.2:1. By "oval" it is meant that the ratio of the lengths of two axes crossing each other at 90° in the center of the fiber cross-section is greater than about 1.2:1. A "snowman" cross-sectional shape can be described as a side-by-side cross-section having a long axis, a short axis and at least two maxima in the length of the short axis when plotted against the long axis.

The fibers can be of any size, for example about 0.5 to about 20 denier per filament (about 0.6 to about 22 dtex per filament). For high crimp contraction levels, for example above about 30%, it is preferred that such novel fibers have a weight ratio of the first component to the second component in the range of about 30:70 to 70:30. More preferably the ratio is in the range of about 40:60 to about 60:40.

The bicomponent fibers can be in the form of continuous filaments or staple fibers. Staple fibers can have a length of about 0.2 to 6 inches (about 0.5 to about 15 cm), more preferably about 0.5-about 3 inches (about 1.3-about 7.6 cm).

The invention is also directed to yarns and fabric comprising the bicomponent fiber. Preferred embodiments include woven fabrics, knitted fabrics and non-woven fabrics.

The invention is also directed to carpets made from the bicomponent fibers (e.g., filaments or staple fibers) of the invention.

Advantages of the invention over fibers and fabrics made from poly(trimethylene terephthalate) and poly(ethylene terephthalate) include significantly better crimp properties, softer hand, higher dye-uptake, and the ability to dye under atmospheric pressure. Of particular note are the high crimp contraction values ranging from about 10% to about 90%.

Another advantage of the inventions is that the spun drawn yarns can be prepared using quite high draw ratio (between 2.0 and 4.0) and in the range of usable wind up speed (2,000 mpm to 4,000 mpm) while maintaining high crimp contraction. Poly(trimethylene terephthalate) orientation is normally increased when spinning speed is increased. With higher orientation, the draw ratio normally needs to be reduced.

EXAMPLES

The following examples are presented for the purpose of illustrating the invention and are not intended to be limiting. All parts, percentages, etc., are by weight unless otherwise indicated.

Physical Properties

Intrinsic Viscosity:

Intrinsic viscosity (IV) was measured with a Viscotek FORCED FLOW VISCOMETER Y900 (Viscotek Corporation, Houston, Tex.). The polymers were dissolved in 50/50 weight % trifluoroacetic acid/methylene chloride at a concentration of 0.4 grams/dL concentration. The viscosity was determined at 19° C. following an automated method based on ASTM D 5225-92. The measured IV values were correlated to IV values measured manually in 60/40 weight % phenol/1,1,2,2-tetrachloroethane following ASTM D 4603-96.

Molecular Weight:

Molecular weight (number average, $M_n$) was measured by size-exclusion chromatography using a size exclusion chromatography system MODEL ALLIANCE 2690™ from Waters Corporation (Milford, Mass.), with a WATERS 410™ refractive index detector (DRI) and Viscotek Corporation (Houston, Tex.) MODEL T-60A™ dual detector module incorporating static right angle light scattering and differential capillary viscometer detectors.

Elongation to Break, Tenacity:

The physical properties of the fibers reported in the following examples were measured using an INSTRON TENSILE TESTER, MODEL 1122 (5500R) from Instron Corp. (Canton, Mass.). More specifically, elongation to break ($E_b$), and tenacity were measured according to ASTM D-2256.

Crimp Contraction:

Unless otherwise noted, the crimp contraction in the bicomponent fibers made as shown in the Examples was measured as follows. Each sample was formed into a skein of 5000+/−5 total denier (5550 dtex) with a skein reel at a tension of about 0.1 gpd (0.09 dN/tex). The skein was conditioned at 70+/−° F. (21+/−1° C.) and 65+/−2% relative humidity for a minimum of 16 hours. The skein was hung substantially vertically from a stand, a 1.5 mg/den (1.35 mgl/dtex) weight (e.g. 7.5 grams for 5550 dtex skein) was hung on the bottom of the skein, the weighted skein was allowed to come to an equilibrium length, and the length of the skein was measured to within 1 mm and recorded as "$C_b$". The 1.35 mg/dtex weight was left on the skein for the duration of the test. Next, a 500 mg weight (100 mg/d; 90 mg/dtex) was hung from the bottom of the skein, and the length of the skein was measured within 1 mm and recorded as "$L_b$". Crimp contraction value (percent) (before heatsetting, as described below for this test), "$CC_b$", was calculated according to the formula:

$$CC_b=100(L_b-C_b)/L_b$$

The 500 g weight was removed and the skein was then hung on a rack and heatset, with the 1.35 mg/dtex weight still in place, in an oven for 5 minutes at about 212° F. (100° C.), after which the rack and skein were removed from the oven and conditioned as above for two hours. This step is designed to simulate commercial dry heat-setting, which is one way to develop the final crimp in the bicomponent fiber. The length of the skein was measured as above, and its length was recorded as "$C_a$". The 500-gram weight was again hung from the skein, and the skein length was measured as above and recorded as "$L_a$". The after heat-set crimp contraction value (%), "$CC_a$", was calculated according to the formula $$CC_a=100(L_a-C_a)/L_a$$

The results are reported in the tables as $CC_a$.

In some examples, crimp contraction levels were measured immediately after drawing and heat-treating by hanging a loop of fiber from a holder with a 1.5 mg/denier (1.35 mg/dtex) weight attached to the bottom of the loop and measuring the length of the loop. Then a 100 mg/den (90 mg/dtex) weight was attached to the bottom of the loop, and the length of the loop was measured again. Crimp contraction was calculated as the difference between the two lengths, divided by the length measured with the 90 mg/dtex weight. This method gives crimp contraction values up to about 10-20% (absolute) higher than the method described above for "$CC_a$". The results are shown in the tables as $CC_a$*.

Bicomponent Fiber Preparation:

The PTT (SORONA polytrimethylene terephthalate, semi-dull, E.I. du Pont de Nemours and Company, Wilmington, Del.) used for the first and second component was the same in each example.

For convenience, reference to the first component is the component containing mainly PTT, and to the second component is to the component containing a polymer composition comprising (i) PTT and (ii) polymer containing polyalkylene ether repeating units.

PTT and second component polymer(s) were dried to less than 50 ppm water content. The dried pellets were melt extruded using a conventional twin-screw extruder. In preparing the polymer composition for the second component, the polymer containing polyalkylene ether repeating units was transferred to the extruder using an injection pump. The blend was extruded at approximately at 240° C. The extrudant flowed into a water bath to solidify the polymer blend into a monofilament, which was then cut into pellets.

In the spinning process for the bicomponent fibers included in the examples the polymers were melted with extruders (Werner & Pfleiderer co-rotating 28 mm extruders having 0.4-40 pound/hour (0.23-18.1 kg/hour) capacities) with 10-16 g/min throughput. The highest melt temperatures attained in the PTT extruder was about 250-265° C. The highest melt temperatures attained on the extruder used for the polymer composition for the second component was about 230-255° C. Pumps transferred the polymers to the spinning head.

The spinneret used was a post-coalescence bicomponent spinneret having thirty-four pairs of capillaries arranged in a circle, an internal angle between each pair of capillaries of 30°, a capillary diameter of 0.64 mm, and a capillary length of 4.24 mm. The spinneret temperature was maintained at less than 265° C. The (post-coalescence) spinneret was recessed into the top of the spinning column by 4 inches (10.2 cm), so that the quench gas contacted the just-spun fibers only after a delay. The quench gas was air, supplied at room temperature of about 20° C. The fibers had a side-by-side cross-section.

In the Examples, unless otherwise indicated, rolls 13 in FIG. 2 were operated at about 70° C., rolls 14 about 90-120° C. and between 1500-2700 mpm, and rolls 15 about 120-160° C. and between 1500-2700 mpm.

In the Examples, the draw ratio applied was about the maximum operable draw ratio in obtaining the bicomponent fibers—2.2 to 4.0.

The fibers were wound up with a BARMAG SW6 2S WINDER (Barmag AG, Germany) having a maximum winding speed of 6000 mpm.

The resultant fibers had a side-by-side cross-section, and the properties described in the following examples.

Unless otherwise noted, the weight ratio of the two polymers (the weight of the total polymer in each component) in the fiber was 50/50.

Transmission Electron Microscopy (TEM):

The fibers were cut to 1 cm lengths and placed in epoxy resin molds. The epoxy was a 2 part Bueller resin which is added to the molds and cured overnight at 65° C. The embedded fibers were then prepared for microtoming by rough facing with a razor blade while being secured in a small vise under a stereo microscope. The faced fiber sample was secured in a Leica ULTRACUT microtome sample holder and cross-sectioned at a cryo-temperature of approximately −90° C. using a diamond knife blade affixed to a small s/s boat. The small 80 nanometer thick cross-sections were captured in the boat filled with ethanol. The ethanol with cross-sections was poured into a petri dish of water. Using a stereo microscope, the cross-sections were secured on small copper grids by surface tension. The grids were secured in the TEM sample holder and electron imaged using a digital camera system. The TEM used was a JEOL 1200EX.

Example 1

Bicomponent fibers according to the invention and a control containing the same PTT as both components were prepared and compared as described below.

The PTT used for both components for the bicomponent fiber preparation in Examples 1-5 is described above and had an IV of 1.02 dl/g.

The polymer containing polyalkylene ether repeating units of the second component was poly(tetramethylene ether) glycol (PO4G) (Invista, Wichita, Kans.) with number average molecular weight ($M_n$) 2000). The PO4G was transferred by an injection pump to the extruder and mixed in the melted PTT. The PO4G content of the obtained pellets was 9.1 wt % based on the total weight of the polymer.

The IV of the PTT/PO4G blend was 0.98 dl/g. The bicomponent fibers were prepared as described above.

Properties of the bicomponent fibers are in Table 1.

For comparison fiber was also prepared using the PTT alone for both components. This result is presented in the Table as "Control".

TABLE 1

PTT//PTT-PO4G Bicomponent Fibers

| Sample | Draw ratio | Draw rolls (° C.) | Anneal rolls (° C.) | Denier | Tenacity (g/d) | Elongation (%) | Crimp CC* (%) | Crimp $CC_a$ (%) |
|---|---|---|---|---|---|---|---|---|
| 1. | 3.5 | 90 | 140 | 143 | 2.64 | 19.2 | 79.0 | 52.7 |
| 2. | 3.0 | 90 | 140 | 112 | 2.37 | 14.8 | 82.5 | 59.7 |
| 3. | 2.8 | 90 | 140 | 102 | 2.46 | 15.8 | 80.0 | 59.5 |
| 4. | 4.0 | 90 | 160 | 194 | 2.87 | 31.9 | — | 27.0 |
| 5. | 3.8 | 90 | 160 | 198 | 2.29 | 29.7 | — | 34.1 |
| 6. | 3.6 | 90 | 160 | 196 | 2.88 | 25.0 | — | 50.0 |
| 7. | 3.4 | 90 | 160 | 209 | 2.75 | 24.1 | — | 49.0 |
| 8. | 3.2 | 90 | 160 | 213 | 2.56 | 26.1 | — | 47.0 |
| 9. | 3.2 | 90 | 160 | 198 | 2.89 | 26.2 | — | 44.4 |
| Control | 3.1 | 90 | 140 | 99 | 3.40 | 26.1 | 2.4 | 1.37 |
| Comp. Examp. A | 2.6 | 90 | 160 | 103 | 3.50 | 25.0 | — | 7.3 |
| Comp. Examp. B | 2.8 | 90 | 120 | 104 | 3.10 | 22.0 | — | 14.7 |

*CC, machine crimp measured immediately after spinning of fibers.

Comparative Example A

Ref. WO 2004/061169 A1 patent. In the bicomponent fiber preparation PTT polymers were used on both side of the fiber having different intrinsic viscosity (1.01 and 0.86 respectively).

Comparative Example B

Ref. US 2004/0084796 A1 patent. In the bicomponent fiber preparation PTT polymers were used on both side of the fiber having different intrinsic viscosity (1.01 and 0.86 respectively).

As indicated in Table 1. the bicomponent fibers were prepared operating the anneal rolls at different temperature. During the spinning the highest wind-up speed was 2550 mpm. The data show that introducing the PO4G in the composition, bicomponent fibers with desired denier can easily attained while maintaining the high level of crimp contraction. The crimp contraction is much higher than in case of the comparative examples where polyesters were spun on both side of the bicomponent fibers.

Example 2

Bicomponent fibers according to the invention and a control containing the same PTT as both components were prepared and compared as described in Example 1, with the following differences. The PO4G content of the obtained pellets was 13 wt %, based on the total polymer weight. The IV of the blend used in making the second component was 0.93 dl/g. Properties of the bicomponent fibers and control fiber are shown in Table 2.

TABLE 2

PTT//PTT-PO4G Bicomponent Fibers

| Sample | Draw ratio | Draw rolls (° C.) | Anneal rolls (° C.) | Denier | Tenacity (g/d) | Elongation (%) | Crimp CC* (%) | Crimp CCa (%) |
|---|---|---|---|---|---|---|---|---|
| 10. | 2.4 | 90 | 140 | 96 | 2.75 | 22.5 | 81.9 | 46.8 |
| 11. | 2.6 | 90 | 140 | 98 | 2.27 | 16.6 | 69.2 | 55.6 |
| 12. | 3.2 | 90 | 140 | 99 | 2.44 | 16.7 | 73.1 | 59.5 |
| 13. | 3.4 | 90 | 140 | 99 | 2.40 | 17.6 | 81.8 | 57.9 |
| 14. | 3.6 | 90 | 140 | 136 | 2.42 | 20.8 | 78.8 | — |
| Control | 3.1 | 90 | 140 | 99 | 3.40 | 26.1 | 2.4 | 1.37 |

*CC, machine crimp measured immediately after spinning of fibers.

The highest operating wind-up speed was 2500 mpm. The data indicate that introducing the PO4G in the composition, bicomponent fibers with desired denier can easily attained while maintaining the high level of crimp contraction.

Example 3

Bicomponent fibers according to the invention and a control containing the same PTT as both components were prepared as described in Example 1 and compared, with the following differences.

The PTT used in both components is described above and had an IV of 1.02 dl/g.

The polymer containing polyalkylene ether repeating units of the second component was a polyether ester copolymer containing poly(trimethylene terephthalate) and poly(tetramethylene ether) repeating units, which was blended with PTT. Thus the copolymer had PO4G segments in a copolymer chain as compared to Examples 1 and 2 where the PO4G was present as homopolymer.

The second component polymer composition was prepared by first preparing a polyether ester copolymer and then melt extruding it with PTT. The polyether ester prepolymer was prepared as follows. A 25 gallon autoclave was charged with 27.2 kg of PTT, 27.2 kg of poly(tetramethylene ether) glycol (PO4G, Invista, Wichita, Kans., $M_n$=2000) having a number average molecular weight of 2,000, and 16 g of TYZOR® TPT titanate catalyst. The temperature was raised to 255° C. and held at that temperature for 5 hours. After quenching, polymer flakes were obtained.

After drying, polyether ester copolymer and PTT pellets were melt extruded using a conventional twin-screw extruder. The blend was extruded at approximately at 240° C. The feed rate ratio of the PTT and the polyether ester prepolymer was 1:1. The extrudant flowed into a water bath to solidify the compounded polymer into a monofilament which was then cut into pellets. The PO4G content of the pellets was 25 wt %. The IV of the compounded polymer was 0.72 dl/g.

Properties of the bicomponent fibers are presented in Table 3.

For comparison fiber was also prepared using PTT of IV 1.02 dl/g for both components. This result is presented in the Table as "Control".

TABLE 3

PTT//PTT-PO4G Polyether Ester Copolymer Bicomponent Fibers

| Sample | Draw ratio | Draw rolls (° C.) | Anneal rolls (° C.) | Denier | Tenacity (g/d) | Elongation (%) | Crimp CC* (%) | Crimp $CC_a$ (%) |
|---|---|---|---|---|---|---|---|---|
| 15. | 3.2 | 90 | 140 | 108 | 2.87 | 33.4 | 31.5 | 19.5 |
| 16. | 3.7 | 90 | 140 | 95 | 2.95 | 23.1 | 46.2 | 14.6 |
| 17. | 3.3 | 120 | 140 | 104 | 2.41 | 25.9 | 40.0 | 20.9 |
| 18.** | 3.2 | 120 | 140 | 111 | 2.49 | 28.6 | 50.0 | 17.8 |
| Control | 3.1 | 90 | 140 | 99 | 3.40 | 26.1 | 2.4 | 1.37 |

*CC, machine crimp measured immediately after spinning of fibers.
**In the bicomponent fiber the PTT//PTT-PEE ratio was 60/40.

The highest operable wind-up speed was 2400 mpm. As the data show in Table 3 the bicomponent fibers were prepared using different draw roll temperature.

The crimp contraction levels observed, while still substantially higher than the control, are lower than the crimp contractions observed in Examples 1 and 2, where the PO4G segments were contained in a homopolymer.

Example 4

Bicomponent fibers according to the invention and a control containing the same PTT as both components were prepared as described in Example 3 and compared, with the following differences.

In this example the PTT/PO4G blend was prepared as described in Example 3 except that the feed ratio of the PTT and the prepolymer was 2:1; i.e., the feed rate of PTT was 5.7 kg/hr and that of the prepolymer 2.8 kg/hr. The extrudant flowed into a waterbath to solidify the polymer into a monofilament which was then cut into pellets. The PO4G content of the pellets was 16.6 wt %. The IV of the blended polymer was 0.83 dl/g.

Properties of the bicomponent fibers are provided in Table 4.

For comparison fiber was also prepared using PTT of IV 1.02 dl/g for both components. This result is presented in the Table as "Control".

TABLE 4

PTT/PTT-PO4G Polyether Ester Copolymer Bicomponent Fibers

| Sample | Draw ratio | Draw rolls (° C.) | Anneal rolls (° C.) | Denier | Tenacity (g/d) | Elongation (%) | Crimp CC* (%) | Crimp CCa (%) |
|---|---|---|---|---|---|---|---|---|
| 19. | 3.2 | 90 | 140 | 106 | 2.61 | 32.1 | 39.5 | 15.2 |
| 20. | 3.6 | 90 | 140 | 95 | 3.15 | 24.4 | 44.6 | 10.9 |
| 21. | 3.2 | 120 | 140 | 101 | 3.34 | 33.3 | 41.4 | 16.0 |
| 22. | 3.4 | 120 | 140 | 100 | 2.79 | 23.9 | 30.4 | 15.7 |
| Control | 3.1 | 90 | 140 | 99 | 3.40 | 26.1 | 2.4 | 1.37 |

CC*, machine crimp measured immediately after spinning of fibers.

The highest operable wind-up speed during the spinning was 2400 mpm. The crimp contraction level is lower than the crimp contraction shown in Table 1 and Table 2.

Example 5

Bicomponent fibers according to the invention and a control containing the same PTT as both components were prepared as described in Example 4 and compared, with the following differences.

Poly(trimethylene ether) glycol (PO3G) having a number average molecular weight of 1,660 was prepared using the procedure described in Example 4 of U.S. Patent Application Publication No. 2002/0007043 A1, which is incorporated herein by reference.

A blend of PTT and PO3G was prepared using the procedures described in Example 1. The blend was extruded at approximately at 240° C. The extrudant flowed into a water bath to solidify the polymer blend into a monofilament which was then cut into pellets. The PO3G content of the obtained pellets was 4.5 wt % based on the weight of the total polymer.

The IV of the PTT/PO3G blend was 0.96 dl/g.

Properties of the bicomponent fibers are in Table 5.

For comparison fiber was also prepared using PTT of IV 1.02 for both components. This result is presented in the Table as "Control".

TABLE 5

| PTT/PTT-PO3G Bicomponent Fibers | | | | | | | |
|---|---|---|---|---|---|---|---|
| Sample | Draw ratio | Draw rolls (° C.) | Anneal rolls (° C.) | Denier | Tenacity (g/d) | Elongation (%) | Crimp CC* (%) |
| 23. | 2.6 | 90 | 140 | 86 | 2.59 | 29.7 | 44.9 |
| 24. | 3.2 | 90 | 140 | 86 | 2.77 | 22.0 | 61.1 |
| Control | 3.1 | 90 | 140 | 99 | 3.40 | 26.1 | 2.4 |

*CC, machine crimp measured after spinning of fibers.

The highest operable wind-up speed during the spinning was 2000 mpm. As the data show in Table 5, the bicomponent fibers had excellent crimp contraction.

Among the commercially available polymers, the disclosed polyester pair in the U.S. Pat. No. 6,841,245 B2 patent was believed to provide the highest crimp contraction. Data comparison shows that using polyester/polyetherester polymer pair of the invention provides the same or higher level of crimp contraction.

The forgoing disclosure of the embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the disclosure.

What is claimed is:

1. A process for preparing a bicomponent fiber comprising:

a. providing as a first component comprising from about 90 to 100 wt. % poly(trimethylene terephthalate);

b. providing as a second component a polymer composition comprising a blend of (i) poly(trimethylene terephthalate) and (ii) polymer containing polyalkylene ether repeating units; and c. spinning and processing the first component and the second component to form the bicomponent fiber having a side-by-side cross-section, wherein the bicomponent fiber has a crimp contraction in the range of 10% to 90%.

2. The process for preparing a bicomponent fiber according to claim 1, wherein the second component comprises (i) 80-99.5 wt % of poly(trimethylene terephthalate) and (ii) 0.5-20 wt % of a polymer containing polyalkylene ether repeating units.

3. The process for preparing a bicomponent fiber according to claim 1, wherein the second component comprises (i) 75-97.5 wt % of poly(trimethylene terephthalate) and (ii) 2.5-15 wt % of a polymer containing polyalkylene ether repeating units.

4. The process for preparing a bicomponent fiber according to claim 1, wherein the step of spinning and processing the first component and the second component to form the bicomponent fiber comprises drawing the bicomponent fiber at temperature in the range of 80° C. to 120° C. at a draw ratio of 2.5 to 4.0.

5. The process for preparing a bicomponent fiber according to claim 1, wherein the weight ratio of the first component to the second component is 50:50.

6. The process for preparing a bicomponent fiber according to claim 1, wherein the weight ratio of the first component to the second component is in the range of 30:70 to 70:30.

7. The process for preparing a bicomponent fiber according to claim 1, wherein the weight ratio of the first component to the second component is in the range of 40:60 to 60:40.

8. The process for preparing a bicomponent fiber according to claim 1, wherein the bicomponent fiber has a crimp contraction in the range of 55% to 90%.

* * * * *